United States Patent [19]

Taylor et al.

[11] Patent Number: 5,005,498

[45] Date of Patent: Apr. 9, 1991

[54] COMPUTER CONTROLLED TUFTING MACHINE AND A PROCESS OF CONTROLLING THE PARAMETERS OF OPERATION OF A TUFTING MACHINE

[75] Inventors: Brooks E. Taylor, Lookout Mountain; Marshall A. Neely, Soddy-Daisy, both of Tenn.

[73] Assignee: Card-Monroe Corporation, Chattanooga, Tenn.

[21] Appl. No.: 590,122

[22] Filed: Sep. 28, 1990

Related U.S. Application Data

[63] Continuation of Ser. No. 388,604, Jul. 1, 1989, which is a continuation of Ser. No. 284,939, Dec. 15, 1988, Pat. No. 4,867,080.

[51] Int. Cl.[5] ..... D05C 15/14

[52] U.S. Cl. ..... 112/80.32; 112/80.73; 112/266.2

[58] Field of Search ..... 112/80.32, 80.23, 80.73, 112/121.11, 266.2; 66/210

[56] References Cited

U.S. PATENT DOCUMENTS

| | | | |
|---|---|---|---|
| 2,932,181 | 4/1960 | MacCaffray | 66/210 |
| 4,267,787 | 5/1981 | Fukuda | 112/80.23 |
| 4,430,870 | 2/1984 | Winter et al. | 66/210 |
| 4,682,554 | 7/1987 | Goto et al. | 112/121.11 X |
| 4,722,288 | 2/1988 | Nomura et al. | 112/121.11 |
| 4,738,209 | 4/1988 | Yanagi et al. | 112/121.11 |
| 4,867,080 | 9/1989 | Taylor et al. | 112/80.32 |

*Primary Examiner*—Werner H. Schroeder
*Assistant Examiner*—John J. Calvert
*Attorney, Agent, or Firm*—Hurt, Richardson, Garner, Todd & Cadenhead

[57] ABSTRACT

A tufting machine is provided with separate motors which drive the main drive shaft, control the feed of the backing material and control the bedrail height. A computer is electrically connected to these motors and to the yarn feed controls. The software indicates patterns to be produced, informing the computer to control the number of stitches per inch of backing, the weight of face yarn per square yard, the pile height, the amount of yarn fed to the needles and the linear length of carpeting produced. The computer also dictates the schedule by which prescribed lengths of additional patterns are produced by the tufting machine and can control a number of such tufting machines. When the pile height is to be changed, the computer automatically controls the main motors for rocking the main shaft, to reciprocate the needles while controlling the yarn feed controls and the motor to the bedrail.

8 Claims, 8 Drawing Sheets

MECHANICAL DIAGRAM

COMPUTER CONTROLLED TUFTING MACHINE AND A PROCESS OF CONTROLLING THE PARAMETERS OF OPERATION OF A TUFTING MACHINE

This is continuation of our application Ser. No. 07/388,604, filed July 1, 1989 which was a continuation of application Ser. No. 284,939, filed Dec. 15, 1988, now U.S. Pat. No. 4,867,080, granted Sept. 19, 1989.

BRIEF DESCRIPTION OF THE INVENTION

This invention relates to a tufting machine and is more particularly concerned with a computer controlled tufting machine and a process of controlling the parameters of operation of a tufting machine.

In tufting machines, it is necessary to synchronize the feed of the backing material across the bed rail with the speed of reciprocation of the needles so as to produce a prescribed number of stitches per inch in a longitudinal direction in the backing material. This determines the number of tufts per linear inch of the backing material. In the event that it is desired to change the number of stitches per inch, it has been necessary in the past, to change the sheaves on the gear box which is connected to the in-feed and out-feed rolls of the tufting machine. Thus, generally speaking, it is difficult to change the number of stitches per inch which are sewn by the tufting machine in a manner to arrive at a predetermined weight for a square yard of such carpeting. Sometimes this involved trial and error as to the size sheave or pulley to be employed on the gear reducer for receiving the timing belt from the main drive shaft. Thus, it was quite time consuming in order to change from producing one particular weight of carpet to producing either a lighter or heavier weight of carpeting, using the same yarn.

In the past, when it was necessary to change pile heights for different patterns of goods, it was necessary to manually adjust the height of the bed rail of the tufting machine so as to have the machine produce a higher or lower tuft. Again, the problem presented itself of predetermining the amount of adjustment of the bed rail which would be necessary in order to produce a fabric having a prescribed density. Usually the change in drive of the in-feed and out-feed rolls and the change in position of the bed rail of the tufting machine required that sample carpets be sewn after each change in order to provide swatches which could be weighed to thereby determine whether or not the changes were sufficient to achieve the desired result.

While counters have been placed on the backing material in order to determine the linear length of carpeting which is produced by a tufting machine, it has, in the past, been left to the operator of the machine to determine when a prescribed linear length of carpeting has been produced to a particular job order. As a result, there are usually overruns of each pattern of carpet so as to assure that the desired amount of carpet has been produced.

Briefly described, the present invention includes a conventional tufting machine which in the present embodiment is a cut pile tufting machine, a yarn feed mechanism for simultaneously feeding a plurality of yarns to the needles of the tufting machine, in-feed and out-feed rolls for the backing material, and synchronous motors the speeds of which are controlled by the computer. One synchronous motor controls the feed of the backing material and the other synchronous motor is attached to the yarn feed mechanism for feeding each needle a prescribed amount of yarn. There are two encoders, one encoder reads the speed of the main drive shaft and the other encoder determines the absolute height of the bedrail. The signals from these encoders are fed to the computer. Programs in the computer prescribe such parameters as the number of stitches to the inch, the weight of the face yarn per square yard, the depth of stroke of the needles, the amount of yarn that is fed to each needle per stroke, the speed of the tufting machine, and the adjustment of the bed rail to provide the appropriate length of tufting. Also prescribed by the software is the linear length of carpeting to be produced according to the particular pattern prescribed.

A number of different patterns and orders for those patterns can be stored in the computer so that there is essentially no interruption between producing one particular pattern and the next pattern to be produced. The computer through the control of the main motors will shut the machine on and off and a stop motion machine is connected to the computer so as to automatically shut down the machine in the event of a break in the yarn.

Accordingly, it is an object of the present invention to provide a tufting machine which requires little attention of an operator and which will inexpensively and efficiently produce tufted fabric.

Another object of the present invention is to provide a tufting machine which can be programmed to produce a prescribed length of tufting.

Another object of the present invention is to provide a tufting machine which can be programmed to produce successively, different prescribed lengths of tufting of different designs.

Another object of the present invention is to provide a tufting machine in which the stitches per inch sewn by the needles can be readily and easily changed as desired.

Another object of the present invention is to provide a tufting machine in which the setting for pile height can be varied as desired.

Another object of the present invention is to provide a tufting machine in which the density of the tufted product can be changed, without the necessity of producing samples to determine whether the appropriate density has been achieved by an adjustment of the machine.

Another object of the present invention is to provide a tufting machine which will automatically produce successive lengths of tufting which have been programmed into the machine.

Another object of the present invention is to provide a process of tufting which will enable an operator to control the product produced from a tufting machine from a remote location.

Other and further objects, features and advantages of the present invention will become apparent from the following description when taken in conjunction with the accompanying drawings wherein like characters of reference designate corresponding parts throughout the several views.

DETAILED DESCRIPTION

Figure 1:
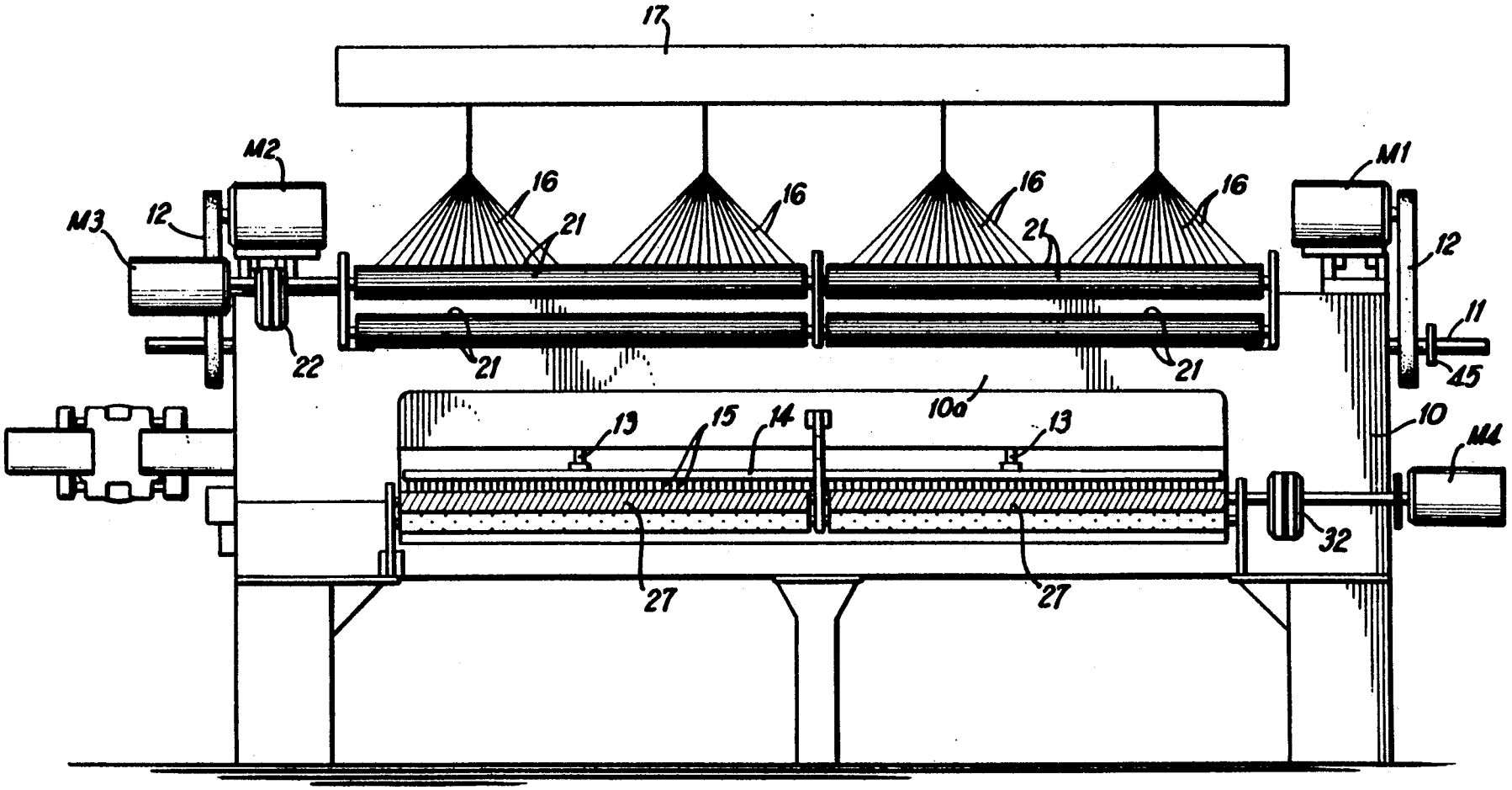
FIG. 1 is a schematic rear elevational view of a tufting machine constructed in accordance with the present invention.
Figure 2:
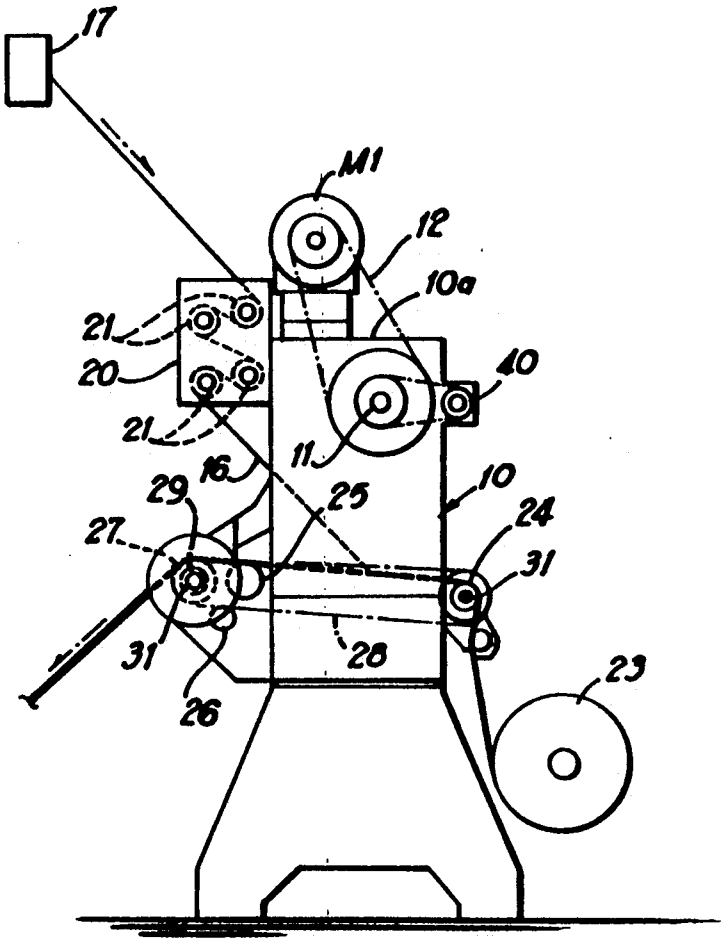
FIG. 2 is a side view elevational view of one side of the machine depicted in FIG. 1.

Referring now in detail to the embodiment chosen for the purpose of illustrating the present invention, numeral 10 in FIGS. 1 and 2 denotes generally the frame of a conventional cut pile tufting machine which includes a conventional main drive shaft 11 driven by belts 12 from main motors M1 and M2.

The shaft 11 reciprocates a plurality of push rods 13 which reciprocate a needle bar 14 which carries a plurality of needles 15. Yarn 16 is supplied to the tufting machine from a yarn supply such as a creel 17, the yarn 16 passing through a yarn feed mechanism or a yarn control 20 and thence to the respective needles 15.

The yarn feed mechanism 20 includes four transversely disposed rollers 21 over which the yarns 16 pass successively and then down to the needles 15. These rollers 21 are synchronized with each other to feed the yarn and are controlled by a synchronous motor M3 through a gear reducer 22.

Figure 3:
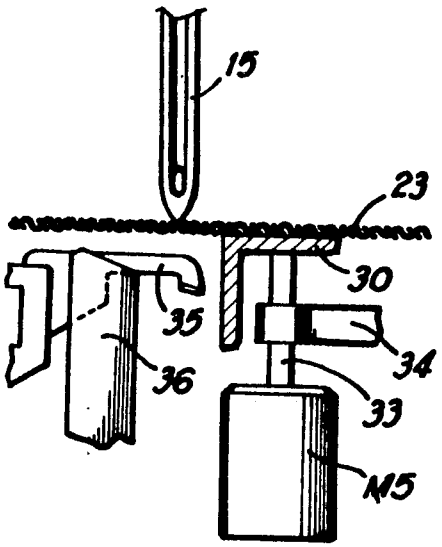
FIG. 3 is a sectional view illustrating the backing material transported over the motor-driven bed rail.

The base fabric or backing material 23 is fed in an essentially horizontally linear path from a roll of backing material up over a front of input drive roll or feed roll 24, passing across the machine over an idler roller 25 and a pin roll 26 and then over a rear or output cloth drive roll or discharge roll 27. A timing belt 28 passing around sheaves or rollers 29 on the drive shafts 31 of the rolls 24 and 27 synchronize the rotation of the shafts 31 so as to rotate the front roll 24 at a slightly slower speed than the rear roll 27, to thereby assure that the backing material 23 is in a taut condition when passing over the bed rail 30 shown in FIG. 3. The pin roll 26 is an idler roller which generates an interrupt signal to the computer for each rotation. The interrupt generated by rotation of the pin roll 26 causes the incrementing of a counter which determines the length of carpet produced.

A motor M4 at the right side of the frame 10 drives a reducers 32 and 18 which in turn drives the rear feed roll 27. Thus, the feed rolls 24 and 27 are driven in synchronization with each other to pass the backing material 23 across the bed rail 30 and beneath the needles 15 for stitching action of the needles 15.

The bed rail 30 is moved upwardly and downwardly as desired by means of motors such as stepping motor M5 which drives through a gear box 37 the bedrail lifts which are screws such as screw 33 which are threadedly carried by brackets such as bracket 34 attached to the frame 10. As is well known, the height of the bed rail 30 will determine how deep the needles 15 sew the loops of yarn which are caught by loopers such as looper 35. The loops are subsequently cut by knives such as knife 36. Since the function of a tufting machine in producing conventional cut pile fabric is well known, a more detailed description of the parts of the tufting machine is not deemed necessary.

According to the present invention, the motors M1, M2, M3, M4 and M5 are respectively controlled so as to dictate the various parameters of the cut pile fabric to be sewn using the machine of the present invention. The motors M1 can be driven either forwardly or rearwardly so that the machine can be rocked back and forth when the bed rail 30 is to be raised so as to permit the cutting of the loops of yarn which are held by the looper. Otherwise, the raising of the bed rail 30 may cause the loops of yarn 16 to break several of the loopers, particularly when the loopers have been subjected to metal fatigue.

Figure 4:
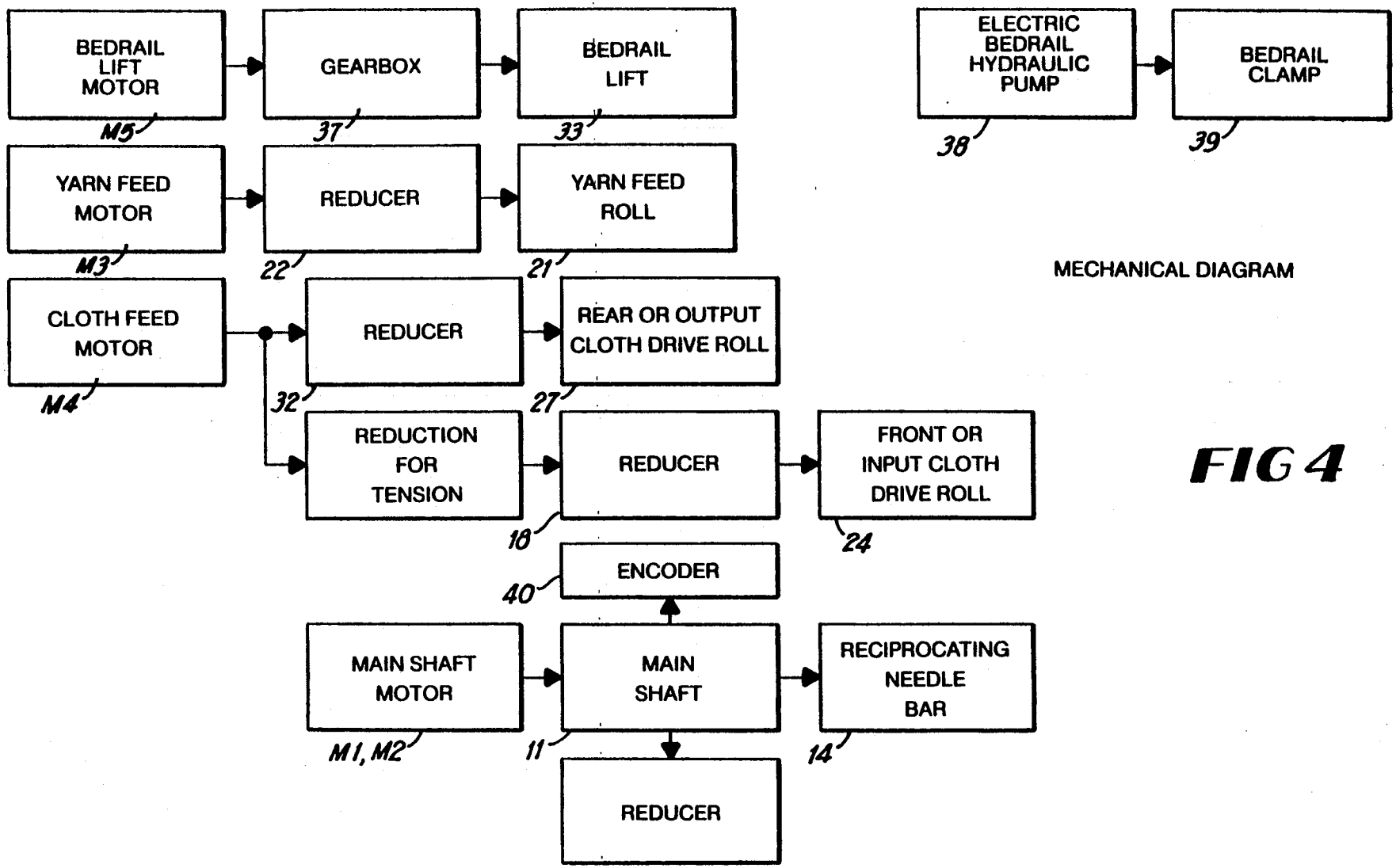
FIG. 4 is a mechanical diagram for the operation of the computer-controlled tufting machine.

FIG. 4 shows a mechanical diagram for the operation of computer-controlled tufting machine 10. The servomotors M3 and M4 drive the yarn feed roll 21 and cloth feed rolls 24, 27, in ratio to the speed of the main shaft 11 by electronic means through gear reducers 22, 32, 18 and tension belt 28. The yarn feed reducer 22 on the yarn feed servomotor M3 changes the ratio between revolutions of the main shaft 11 to fractions of a revolution of the yarn feed roll 21 to vary the yarn feed between 0.35 and 3 inches of yarn per revolution of the main shaft. Similarly, the cloth feed reducers 32, 18 change the ratio between revolutions of the main shaft 11 to the fraction of the revolution of the front and rear cloth feed drive rolls 24, 27 to vary the backing feed rate between 0.06 and 0.2 inches of backing per revolution of the main shaft 11.

The main shaft motors M1, M2 rotate the main shaft 11 which drives the reciprocating needle bar 14. An optical encoder 40 mounted on main shaft 11 and consisting of a light emitting diode, a photocell and a slotted disk between the diode and photocell, is an incremental shaft-angle encoder that follows the rotation of the main shaft and transmits an electrical input signals to both the cloth feed motor M4 and to the yarn feed motor M3. Bedrail lift motor M5 is a stepper motor cOntrOlled by computer 50 and raises and lowers the bedrail 30 through the gear box 37. An absolute encoder 45 located on the output shaft of gear box 37 senses the position of bedrail 30. Also shown in FIG. 4 is electric bedrail hydraulic pump 38 which cooperates with motor M5 to operate bedrail clamp 39 to lock the bedrail 30 in place when motor M5 is stopped after it is raised or lowered the bedrail 30. The absolute encoder 45 driven from main shaft 11 provides a binary-coded-decimal coded digital output word for each discrete displacement increment of the bedrail.

Figure 5A:
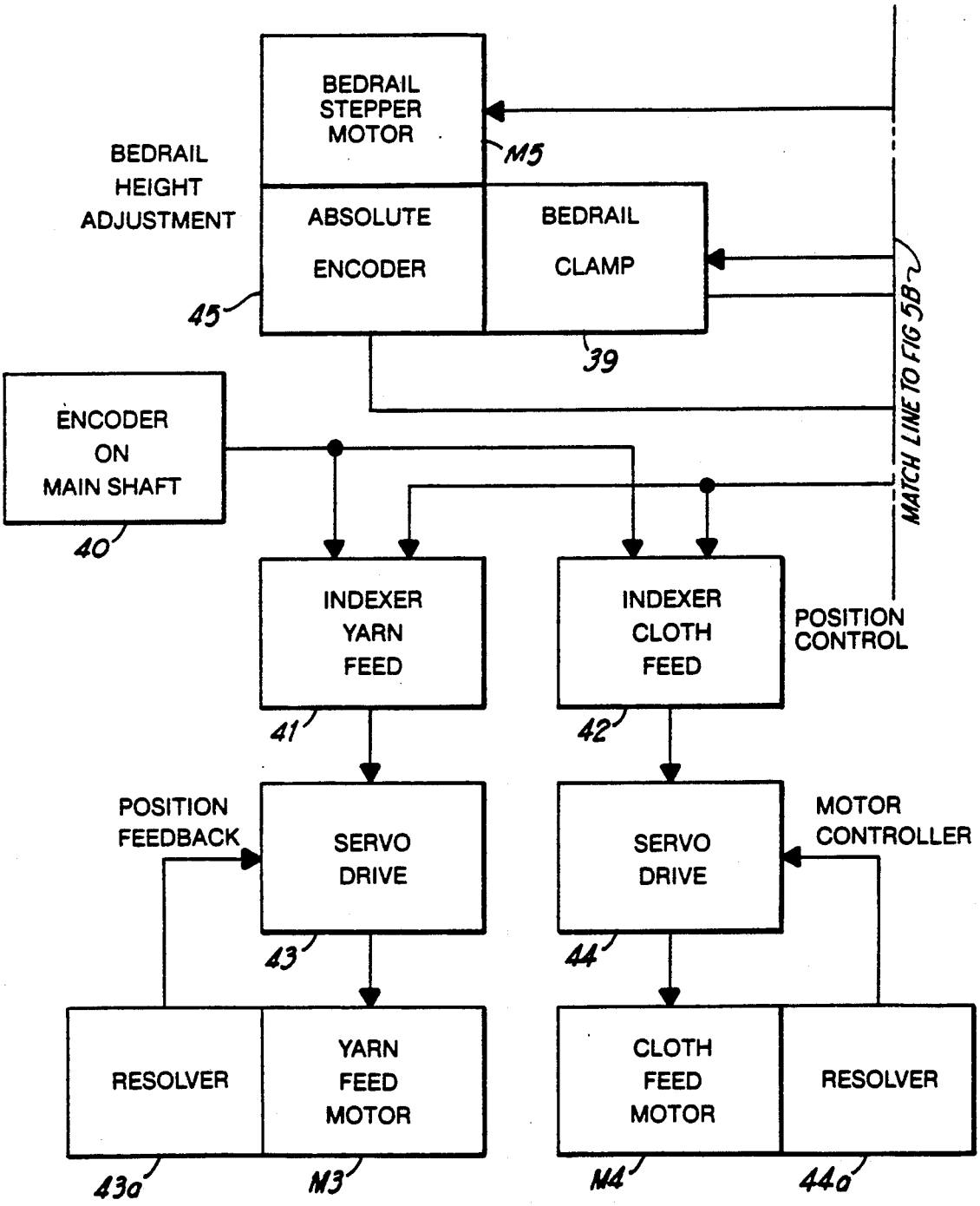
FIG. 5A is part of an electrical flow diagram for the operation of the computer-controlled tufting machine.
Figure 5B:
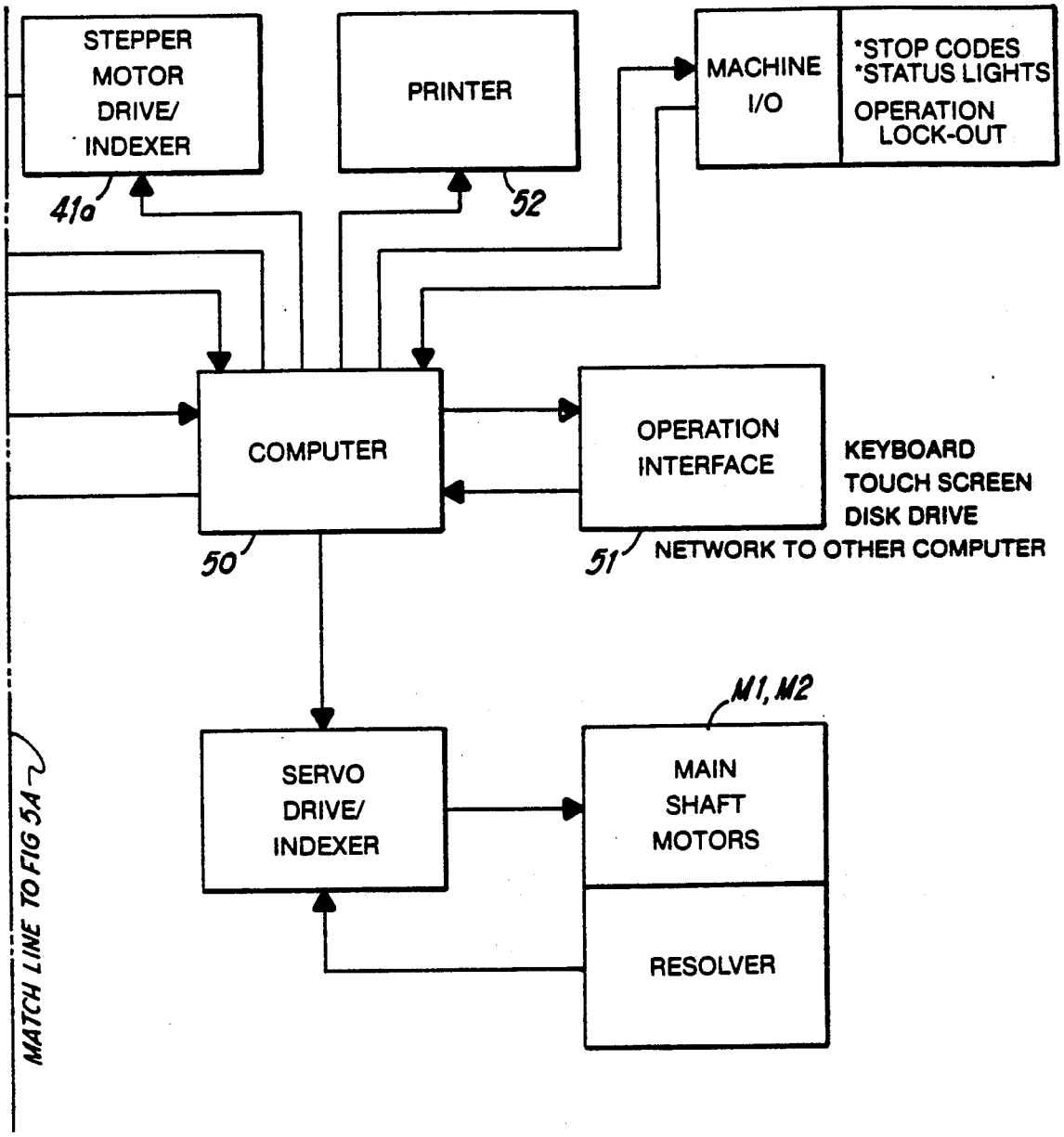
FIG. 5B is the other part of the diagram of FIG. 5A.

The electrical components of the computer-controlled tufting machine 10 are shown in the block diagram of FIG. 5A and 5B. Microprocessor-based computer 50 provides status information to the operator through operation interface 51 which in the preferred embodiment is a touch screen. Permanent style information is stored in battery backed-up random access memory. In an alternate embodiment, the interface may be a keyboard (not shown) for input and to a disk drive (not shown) for permanent storage of style information on disk. In still another alternate embodiment the interface 51 may consist of a plurality of microcomputers (not shown) networked to a central computer (not shown) to permit control of a multiplicity of tufting machines from one source. Style information and job orders would then be entered and stored at the location of the central computer. The computer 50 also interfaces with a printer 52 to provide automatically run data on operation of the tufting machine along with statistical data on efficiency of operation of the machine during a specific period of time such as a work shift duration.

The computer 50 controls the setting of the indexer 41 for the yarn feed and the indexer 42 for cloth feed 42 which, in turn, controls operation of yarn feed motor M3 and cloth feed motor M4, respectively, through servo drives 43 and 44. The resolver **43*a* on yarn feed motor M3 provides position information to the yarn feed servo drive 43. Similarly, the resolver 44*a* on cloth feed motor M4 provides feedback to the cloth feed servo drive 44 to control the rate of feed of the backing material 23**.

The indexers 41, 42 are set with the correct ratio information through computer 50. The ratio information is fed to the gear reducers 22, 32 which control the ratio between revolutions of the main shaft 11 to fractions of revolutions of the yarn feed roll 21 and the cloth feed roll 24, respectively. Changing the two ratios determines the style of carpet, i.e., the depth and density of the carpet. The encoder 40 on the main shaft 11 follows the rotation of the main shaft 11 and sends a pulse to the indexers 41, 42 for every rotation of the main shaft 11. The indexers 41, 42 comprise electrically erasable programmable read only memory (EEPROM). The input signals from main shaft encoder 40 are used by each indexer 41 or 42 to output a pulse stream to the respective servo drive 43, 44 which control operation of the yarn and cloth feed servo motors M3, M4. Each pulse from the indexers 41, 42 is translated into steps on servo drives 43, 44. For the yarn feed rolls 21, there are between 0.5–5 steps on the servo drive 43 for each pulse from the encoder 40. The computer 50 is also used to set up interrupts and an interrupt occurs for every complete revolution of the cloth roll 27. The cloth roll 27 is a spike roll which might typically have a circumference of 12.566 inches. Each interrupt results in the incrementing of a counter representing the linear length of carpet produced.

SYSTEM OPERATION

When the computer-controlled tufting machine 10 is powered up, the resident software program defining the operator interface 51 goes through a system initialization cycle wherein the graphics mode is set, the indexers 41, 42 for the yarn feed and cloth feed are reset, the touch screen 70 is initialized, interrupts are enabled, timers are initialized and the tufting machine 10 is "locked out" to prevent inadvertent operation.

Figure 6:
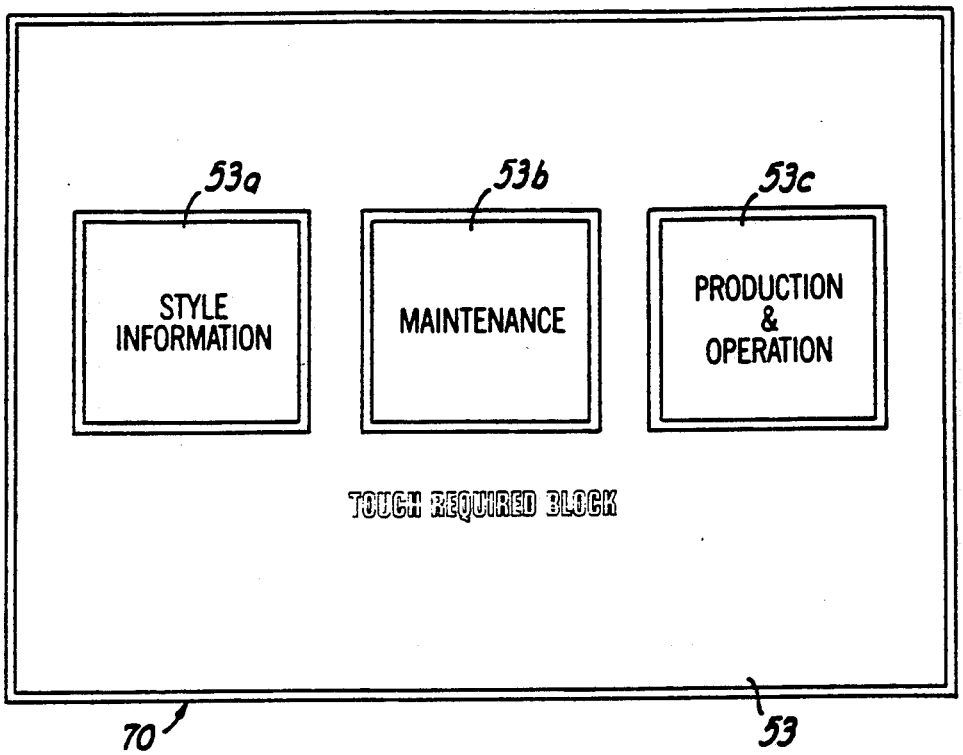
FIG. 6 is an illustration of the main operation interface menu-driven screen display.
Figure 7:
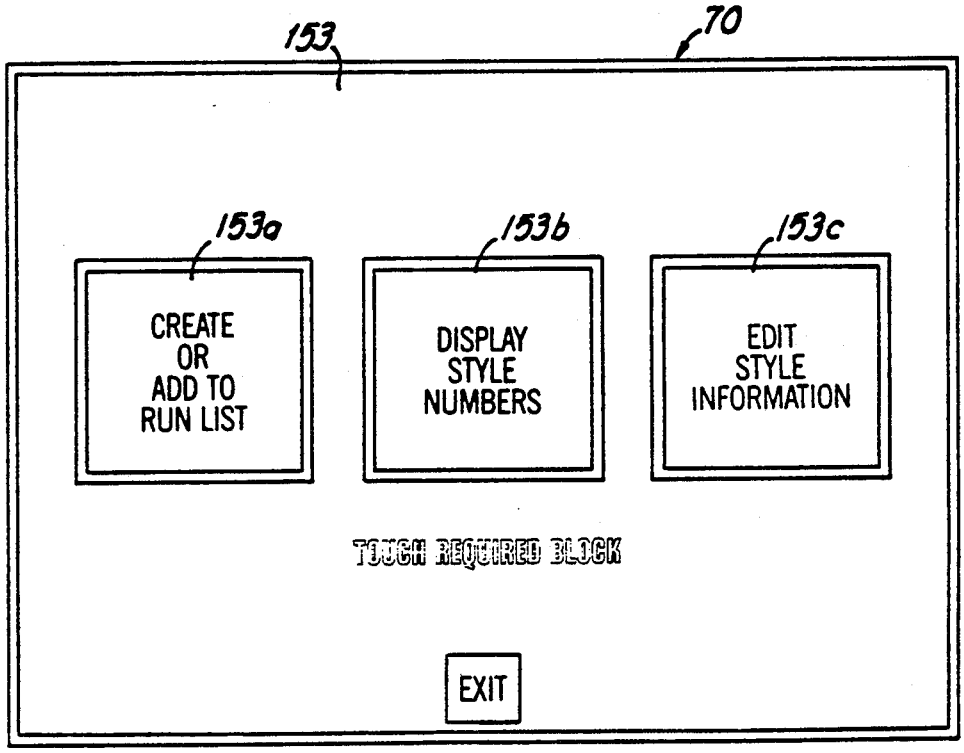
FIG. 7 is an illustration of the STYLE INFORMATION menu-driven screen display.

After the system is initialized the first menu is displayed. Each menu requires operator interaction before another menu can be displayed. As indicated in FIG. 6, the machine operator is given the choice on touch screen 53 of setting style information block **53*a*, selecting the maintenance mode block 53*b* or selecting the production mode block 53*c*. If STYLE INFORMATION block 53*a* were selected by operator the operator would touch on that area of the display screen 53, whereby the operator is provided with the screen display 153 in FIG. 7. As indicated in FIG. 7 the choices available are creating or adding to the run list block 153*a*, displaying the style numbers 153*b* in the style data base, or changing an existing style 153*c*** in the style data base. There is an exit option available on each screen, after the initial one, which will enable the operator to back up to the immediately preceding menu.

Figure 8:
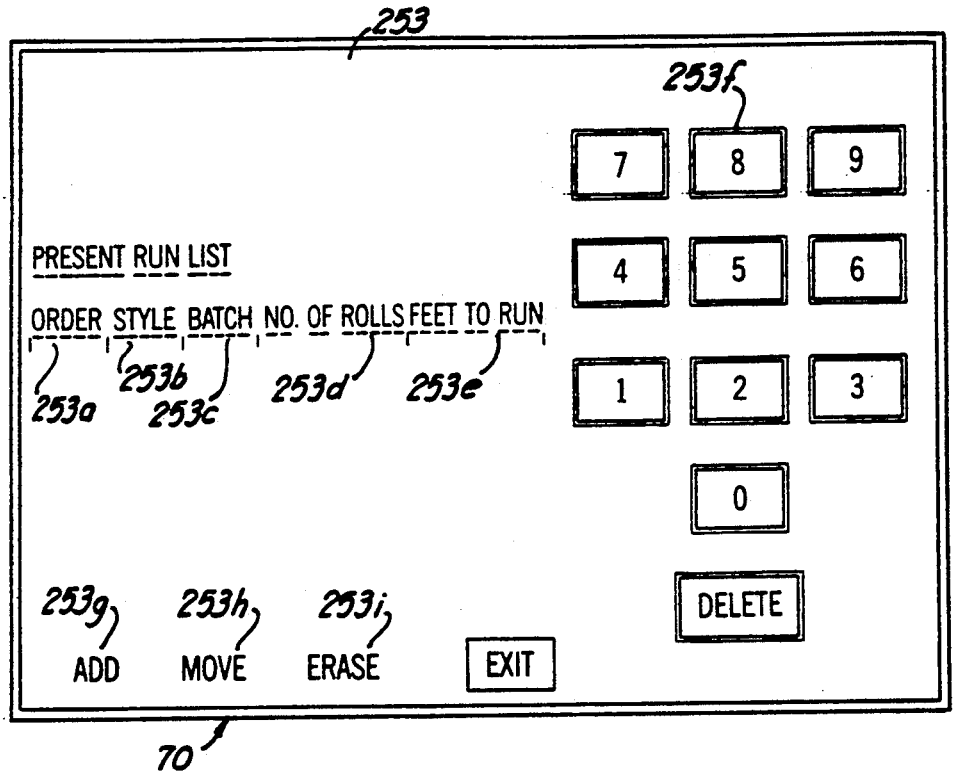
FIG. 8 is an illustration of the DISPLAY RUN LIST menu-driven screen display.
Figure 9:
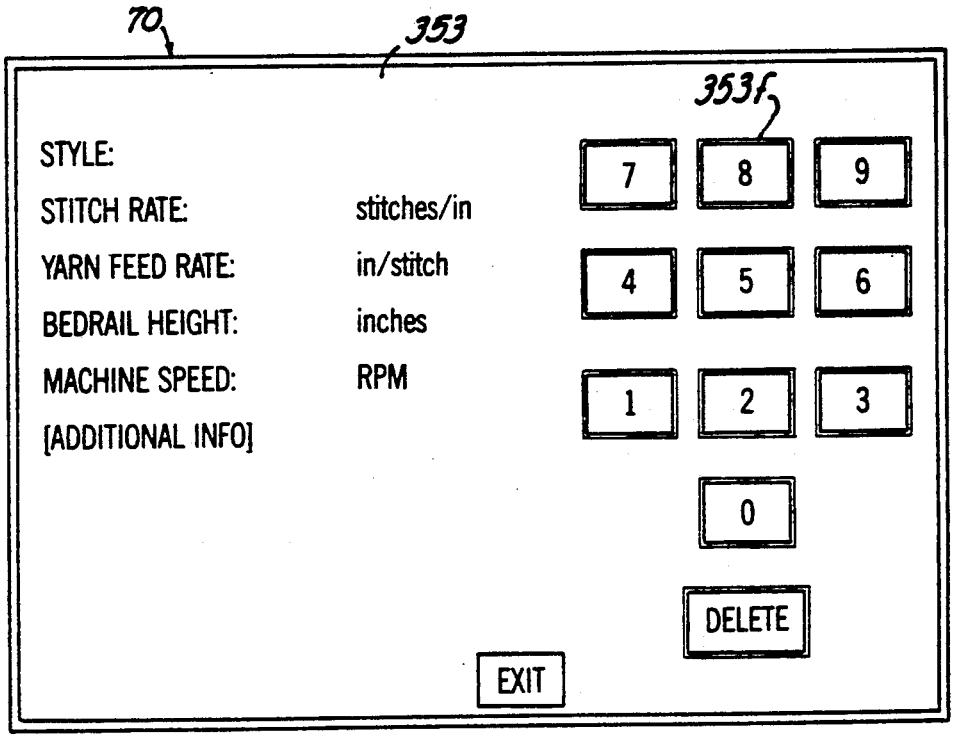
FIG. 9 is an illustration of the DISPLAY STYLE INFORMATION menu-driven screen display.

If CREATE OR ADD TO RUN LIST block **153*a* were chosen, then the operator is given the screen display 253 depicted in FIG. 8, which lists the present run list, if any, in columnar format. The first column 253*a* displays the order number, the second column 253*b* the style number, the third column 253*c* the batch number, the fourth column 253*d* the number of rolls and the final column 253*e* the number of feet of carpet to run on a particular job. The FEET TO RUN is the product of the number of rolls and the roll length, both of which are user inputs. The operator has a numeric touch sensitive key pad 253*f* on the right half of the display screen 53 enabling him to select any digit or to delete an erroneous entry. The operator selects from the add block 253*g*, move block 253*h*, or erase block 253*i* options. If ADD is selected, the screen display will prompt the operator, in the area of the display above the present run list, for a style number, a batch number, the number of rolls, and a run length. The order number is incremented automatically in the add mode and the entire job is added to the run list. The operator touches the MOVE block 253*h* on screen 253 to move a job order from one point on the run list to another which can be either higher or lower. The operator is again prompted on the screen for input in the move mode. The key pad is used to select both the order number of the job to be moved and the order number for it to be moved to on the run list. The ERASE block 253*i*** is touch activated when the operator wants to erase a job entirely from the run list. The touch key pad is used to enter the order number to remove from the run list in response to screen prompts.

Figure 10:
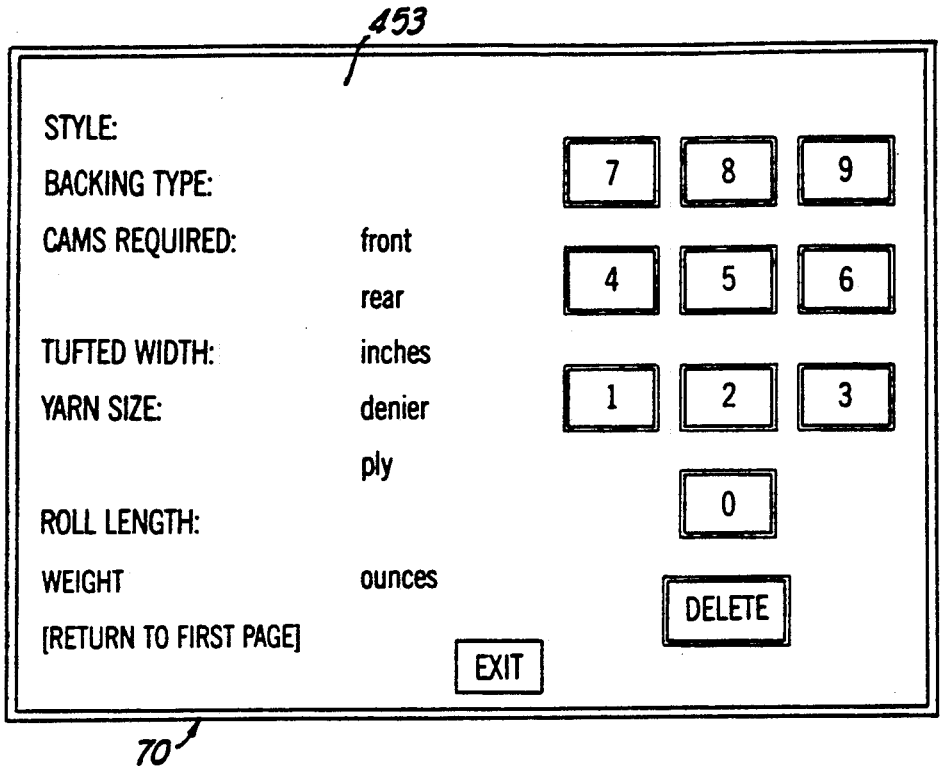
FIG. 10 is an illustration of the DISPLAY ADDITIONAL SYTLE INFORMATION screen display.

When DISPLAY STYLE NUMBERS pad **153*b* is selected, the operator is presented with a list of style numbers that are presently stored in memory. An EXIT pad is provided to leave this function. The user is prompted in succession for the associated stitch rate, yarn feed rate, bedrail height, and tufting machine speed in revolutions per minute. The numeric touch key pad 353*f* is again depicted on the right half of the screen 353 for user data entry. A second menu 453 depicted in FIG. 10** is then presented for entry of backing type, the number of front and rear cams required, the tufted width, the yarn size (denier and ply), the roll length, and carpet weight (in ounces).

When EDIT STYLE INFORMATION pad **153*c* is selected, the operator is presented with display 353 depicted in FIG. 7. The operator first inputs a style number. If the style number does not already exist in memory, then all the variables which are required to define that style are then initialized to zero by the computer 50. If the style number does already exist then the computer 50** loads from permanent storage the style information associated with the style number. The user then edits the information relating to that style.

The maintenance mode (Block **53*b***) will allow the following operations:

1. Running only the cloth or yarn feed motors (M4 or M3) for threading the machine or changing the backing 23;
2. Setting the stopping position of the needle bar 14; and
3. Raising or lowering the bedrail 30 for system tests.

Figure 11:
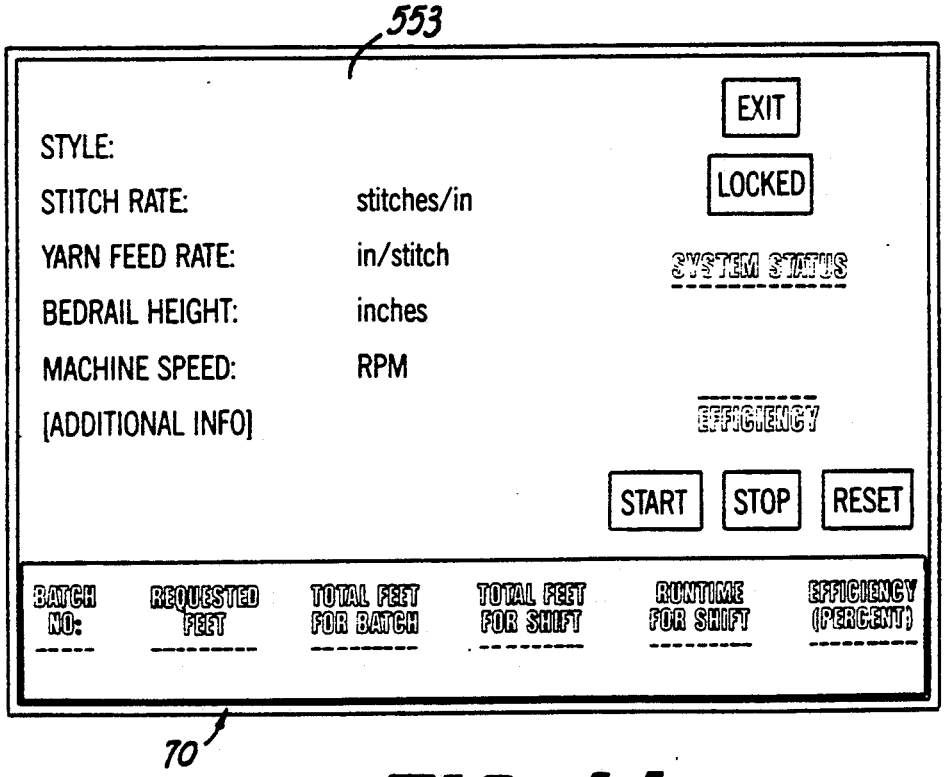
FIG. 11 is an illustration of the PRODUCTION & OPERATION display.

Selection of PRODUCTION & OPERATION block **53*c* on the screen displayed in FIG. 6 will present the user with the screen 553 display depicted in FIG. 11. The style number at the top of the run list is read and the corresponding style information is retrieved from the permanent storage medium (e.g. random access memory) and displayed on the left side of the screen. STAND-BY is written to the system status line on the screen display. The computer 50 loads the indexers 41, 42 with the correct ratio information. After the indexers 41, 42 are loaded, the machine lock-out is removed enabling the machine to operate. MACHINE READY is then written to the system status line on the screen display 553. The system is initialized to non-active status and then to screen lock. The tufting machine 10** can be operated now, but efficiencies will not be calculated.

At this point the machine is idle and waiting for operator input. The operator starts the operation of the machine by the separate machine controls. FIG. 11 indicates that there are six possible operator inputs having to do with calculation and display of production run statistics. The ADDITIONAL INFO option displays the additional information shown in FIG. 10. The LOCKED option causes the screen lock-out to be toggled. The START, STOP, RESET and EXIT options are affected by the screen lock-out. When the screen 553 is not locked-out, START initializes efficiency calculations, STOP suspends efficiency calculations, RESET serves to reinitialize efficiency calculations and sets the timers to zero. EXIT returns the display screen to that shown in FIG. 6. As the batch is being produced on the tufting machine 10, the information indicated on the lower part of the menu is displayed and continuously updated at the screen refresh rate. This information includes batch number, requested feet, total feet for the batch, total feet for the shift, run time for shift, and efficiency (percent).

It is to be understood that the invention is not limited by the specific illustrative embodiments described herein, but only by the scope of the appended claims.

What is claimed is:

1. A tufting machine assembly of the type having reciprocating needles for inserting yarns carried by the needles through a backing material as the backing material is progressively fed through the tufting machine and across the path of reciprocation of said needles and so that said needles produce tufts in said backing material, the improvement comprising:

(a) a first means for controlling the feed of said backing material through the tufting machine;

(b) a computer means coupled to said first means;

(c) second means for generating signals indicative of the speed of reciprocation of said needles;

(d) means coupling said second means to said computing means; and (e) input means connected to said computer means for prescribing to said computing means the number of stitches per prescribed length of backing material to be produced by said needles, whereby said computing means controls through said first means, the speed of said backing material through said tufting machine.

2. The tufting machine assembly defined in claim 1 wherein said input means is a keyboard.

3. The tufting machine assembly defined in claim 1 wherein said input means first means delivers all of the yarns to the needles at the same speeds.

4. The process of tufting wherein needles insert yarns carried by the needles through a backing material as the backing material is progressively fed through a tufting machine and across the path of reciprocation of the needles so that the needles produce tufts in the backing material, comprising the steps of:

inputting to a computer the parameters for the lengths of said tufts to be produced in successive prescribed lengths of said backing material, controlling by said computer the feed of said yarn to said needles, detecting when each prescribed length of said backing material has been fed through said tufting machine, and altering the lengths of yarns fed to said needles in accordance with the inputted parameters.

5. A tufting machine assembly of the type having reciprocating needles for inserting yarns carried by said needles through a backing material as the backing material is progressively fed through the tufting machine and across the path of reciprocation of said needles and so that said needles produce tufts in said backing material, the improvement comprising:

(a) first means for controlling the feed of said yarns to said needles;

(b) a computing means coupled to said first means;

(c) second means for generating signals indicative of the speed of reciprocation of said needles;

(d) means coupling said second means to said computing means; and (e) input means connected to said computing means for prescribing to said computing means the height of tufts to be produced by said needles in said backing material; whereby said computing means controls, through said first means, the lengths of yarns fed by said first means to said needles.

6. The tufting machine assembly defined in claim 5 wherein said input means is a keyboard.

7. The tufting machine assembly defined in claim 5 wherein said input means first means delivers all of the yarns to the needles at the same speeds.

8. The process of tufting wherein needles insert yarns carried by the needles through a backing material as the backing material is progressively fed through a tufting machine and across the path of reciprocation of the needles so that the needles produce tufts in the backing material, comprising the steps of:

inputting to a computer the parameters for the lengths of tufts and the stitches per inch to be produced by the tufting machine and controlling by said computer, the lengths of yarns to be fed to said needle and the speed at which said backing material is fed through said tufting machine, feeding signals to said computer which are a function of the speed of reciprocation of said needles and the travel of said backing material through said tufting machine, and controlling the amount of yarns fed to said needles and the amount of backing material fed beneath said needles in accordance with parameters dictated by said computer.

* * * * *